United States Patent [19]

Horie

[11] Patent Number: 5,063,867

[45] Date of Patent: Nov. 12, 1991

[54] ZIGZAG SEWING MACHINE

[75] Inventor: Fujio Horie, Nagoya, Japan

[73] Assignee: Brother Kogyo Kabushiki Kaisha, Nagoya, Japan

[21] Appl. No.: 448,892

[22] Filed: Dec. 12, 1989

[30] Foreign Application Priority Data

Dec. 20, 1988 [JP] Japan ..... 63-322292

[51] Int. Cl.[5] ..... D05B 3/02

[52] U.S. Cl. ..... 112/443; 112/453; 112/221; 112/303; 112/321

[58] Field of Search ..... 112/157, 220, 303, 306, 112/308, 314, 321, 443, 448, 453, 455, 456, 457, 221, 312, 323

[56] References Cited

U.S. PATENT DOCUMENTS

| | | | |
|---|---|---|---|
| 3,984,745 | 10/1976 | Minalga | 112/220 X |
| 4,123,981 | 11/1978 | Brown | 112/321 X |
| 4,135,462 | 1/1979 | Brown | 112/321 X |
| 4,187,794 | 2/1980 | Ross et al. | 112/453 X |
| 4,226,199 | 10/1980 | Adams | 112/308 |
| 4,539,925 | 9/1985 | Shim | 112/314 |
| 4,691,654 | 9/1987 | Meier . | |
| 4,744,319 | 5/1988 | Rohr | 112/306 |

*Primary Examiner*—Werner H. Schroeder
*Assistant Examiner*—Paul C. Lewis
*Attorney, Agent, or Firm*—Oliff & Berridge

[57] ABSTRACT

A zigzag sewing machine comprising a needle bar lateral drive device, a needle bar lateral drive steppping motor for controlling the needle bar drive device, a feed device for driving a feed dog back and forth, a crossfeed device for driving the feed dog from side to side, and a crossfeed stepping motor for controlling the feed drive device. The sewing machine can sew beautiful pattern stitches and neat stitches by setting up amplitude according to the minimum feeding pitch of the feed dog which is smaller than the minimum moving pitch of the needle bar. Since the needle location is determined by cooperation between the needle bar and the feed dog, the maximum lateral moving width of the needle is shorter than amplitude and the needle can be securely and accurately driven even at a high sewing speed. Furthermore, the needle bar lateral drive stepping motor, the feed stepping motor, and the crossfeed stepping motor do not have to be bestowed with either high resolution or high speed responsiveness, and the zigzag sewing machine can be manufactured at a relatively low price.

12 Claims, 10 Drawing Sheets

ZIGZAG SEWING MACHINE

BACKGROUND OF THE INVENTION

This invention relates to a zigzag sewing machine, more particularly to a zigzag sewing machine in which minimum crossfeeding pitch of a feed dog controlled by a crossfeed device is smaller than the minimum laterally moving pitch of a needle and thus the amplitude or relative moving distance between the needle and a fabric can be minutely set.

Generally speaking, prior-art electronic zigzag sewing machines have in an arm a needle bar vertical drive mechanism, a needle bar lateral drive mechanism, and a needle bar lateral drive stepping motor for controlling the needle bar lateral drive mechanism, and have in a bed a vertical feed mechanism for moving a feed dog up and down, a feed mechanism for moving the feed dog back and forth, and a feed stepping motor for driving the feed mechanism. The sewing machines can sew a variety of stitches such as straight stitch, zigzag stitch, buttonhole stitch, overlock stitch, and a plurality of pattern stitches forming characters, ideograms, etc. The maximum lateral moving range of the needle bar is about 7 mm, the maximum width of patterns is also 7 mm, and the minimum lateral moving pitch of the needle bar is about 0.5 mm.

Recently new-type zigzag sewing machines have been proposed. The sewing machines are provided with a crossfeed mechanism for driving a feed dog from side to side by means of a stepping motor or a solenoid in synchronization with the feeding movement of the feed dog. Thus, the sewing machines can sew patterns with larger width.

For example, in U.S. Pat. No. 4,691,654 a zigzag sewing machine is suggested which comprises a vertical feed mechanism for moving a feed dog up and down, a feed mechanism for moving the feed dog back and forth, and a crossfeed mechanism for moving the feed dog from side to side. The vertical feed mechanism uses an eccentric cam fixed on a shaft rotated by a sewing machine motor. In the feed mechanism, the inclination of a feed controller is adjusted by a feed stepping motor, the eccentric cam moves a slider by means of a lever and a link bar, and the feed dog is moved back and forth via a link mechanism comprising a connecting bar and a feed member. In the crossfeed mechanism, a feed dog supporting member is pressed to and contacted with a needle sleeve on its side wall, and a crossfeed stepping motor rotates a lateral drive member moving the feed dog laterally while the feed dog moves back and forth. The center of the needle sleeve is beside the center of rotation of the lateral drive member.

Since the minimum lateral moving pitch of the prior-art zigzag sewing machines is about 0.5 mm, the sewing machines cannot sew either beautiful patterns with curved lines, such as characters and ideograms, or stitches parallel to creases of a fabric. A sewing machine having minimum laterally moving pitch of about 0.1 mm can sew such beautiful patterns and neat stitches, but an expensive stepping motor with high resolution and high-speed responsiveness is required. The above-mentioned zigzag sewing machine of U.S. Pat. No. 4,691,654 has the same problems, because the purpose of its crossfeed mechanism is sewing patterns of larger width than other prior-art sewing machines.

SUMMARY OF THE INVENTION

It is an object of the invention to provide a zigzag sewing machine where the minimum relative lateral moving pitch of a needle and a fabric is smaller than that of prior-art sewing machines because full use is made of a crossfeed mechanism and beautiful and neat patterns and ideograms can be formed.

The object is realized by an electronic zigzag sewing machine comprising a needle bar lateral drive mechanism for moving a needle bar and a needle orthogonally to the feeding direction, lateral drive stepping motor for driving the lateral drive mechanism, a feed mechanism for feeding a fabric in synchronization with the vertical movement of the needle bar, a crossfeed mechanism for feeding the fabric in the direction of the needle bar lateral movement in synchronization with the feeding movement of the feed dog, and a crossfeed stepping motor for controlling the crossfeed mechanism. In the electronic zigzag sewing machine, the minimum feeding pitch of the feed dog by the crossfeed mechanism controlled by the crossfeed stepping motors is smaller than minimum lateral moving pitch of the needle bar by the needle bar lateral drive mechanism.

BRIEF DESCRIPTION OF THE DRAWINGS

This invention is illustrated diagrammatically in the accompanying drawings wherein.

DETAILED DESCRIPTION OF PREFERRED EMBODIMENTS

Figure 1:
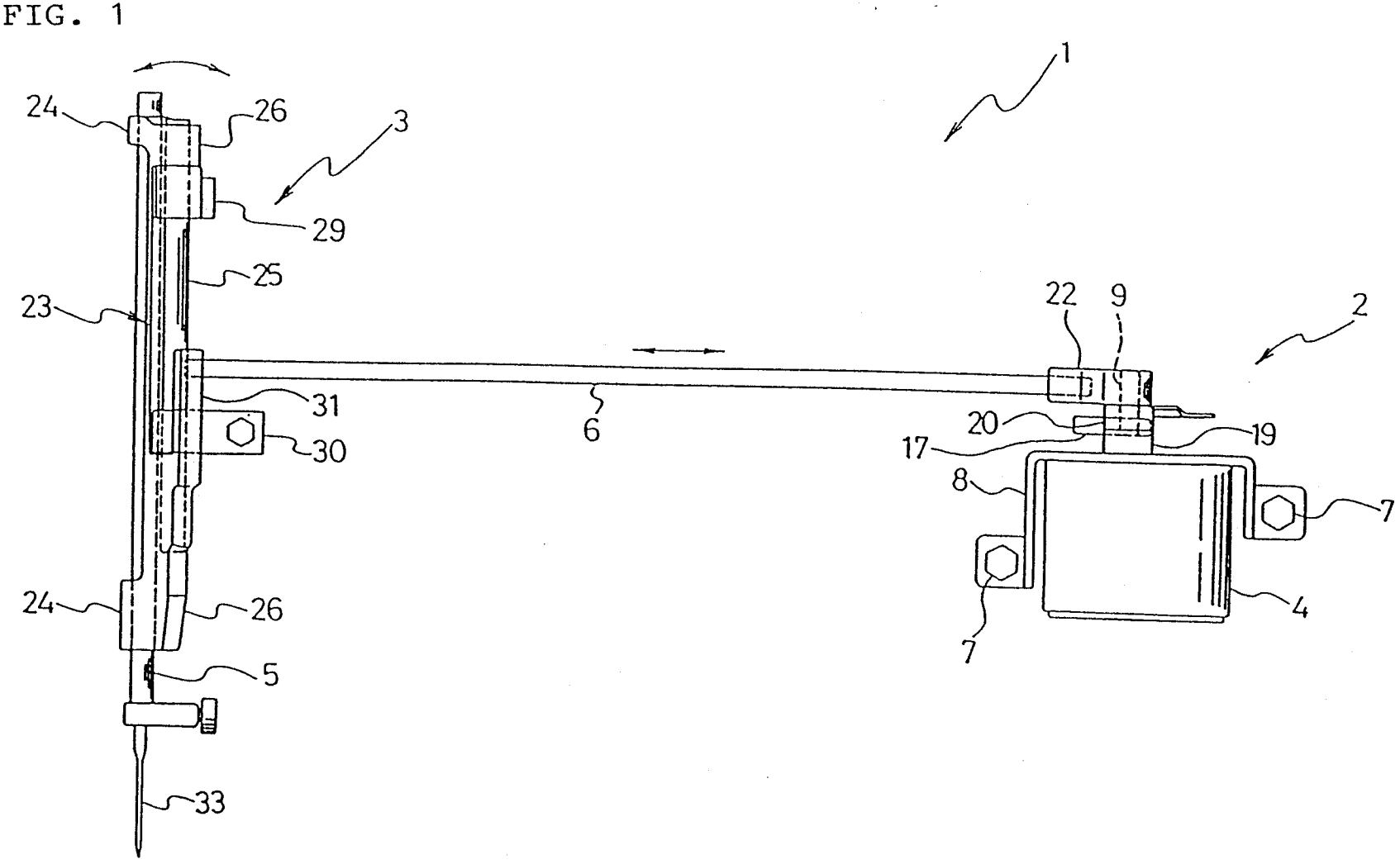
FIG. 1 is a front view of a needle bar lateral drive device of an electronic zigzag sewing machine of the present invention.

Set forth is an explanation of an embodiment of the present invention with reference to the attached drawings FIG. 1 through FIG. 10. In this embodiment, the present invention is applied to an electronic zigzag sewing machine.

The electronic zigzag sewing machine has in an arm a needle bar vertical drive device for driving a needle bar 5 up and down and a needle bar lateral drive device for driving the needle bar 5 from side to side, and in a bed 39 a vertical feed device for moving a feed dog 48 up and down, a feed device for moving the feed dog 48 back and forth, a feed stepping motor 49 (see FIG. 7) for controlling the feed device, a crossfeed device 89 for moving the feed dog 48 from side to side, and a crossfeed stepping motor 90 for controlling the crossfeed device 89.

Figure 2:
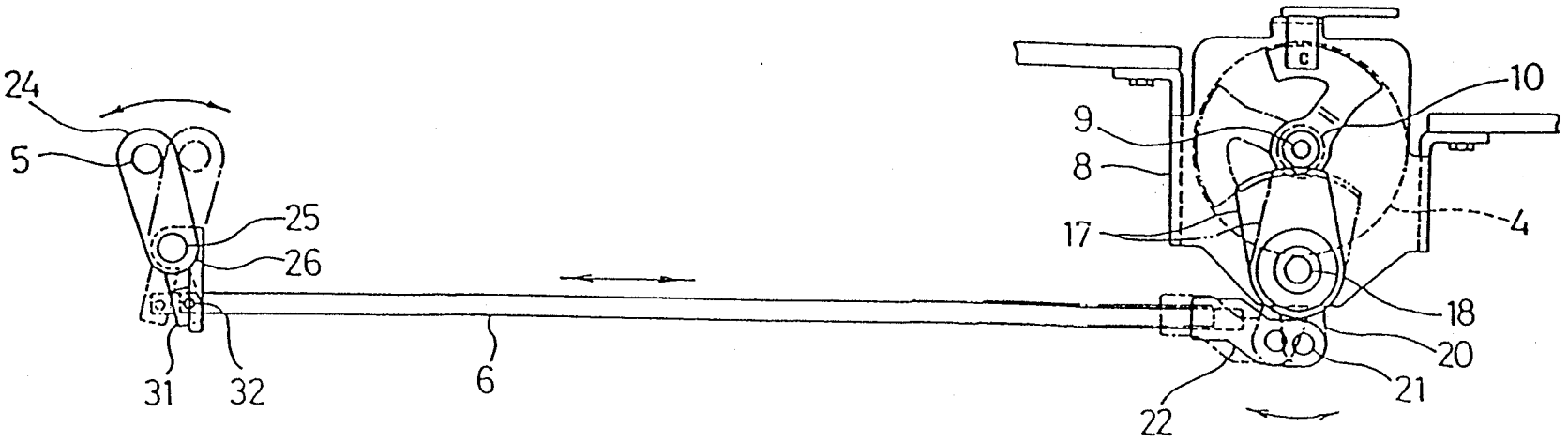
FIG. 2 is a plan view of the needle bar lateral drive device shown in FIG. 1.
Figure 3:
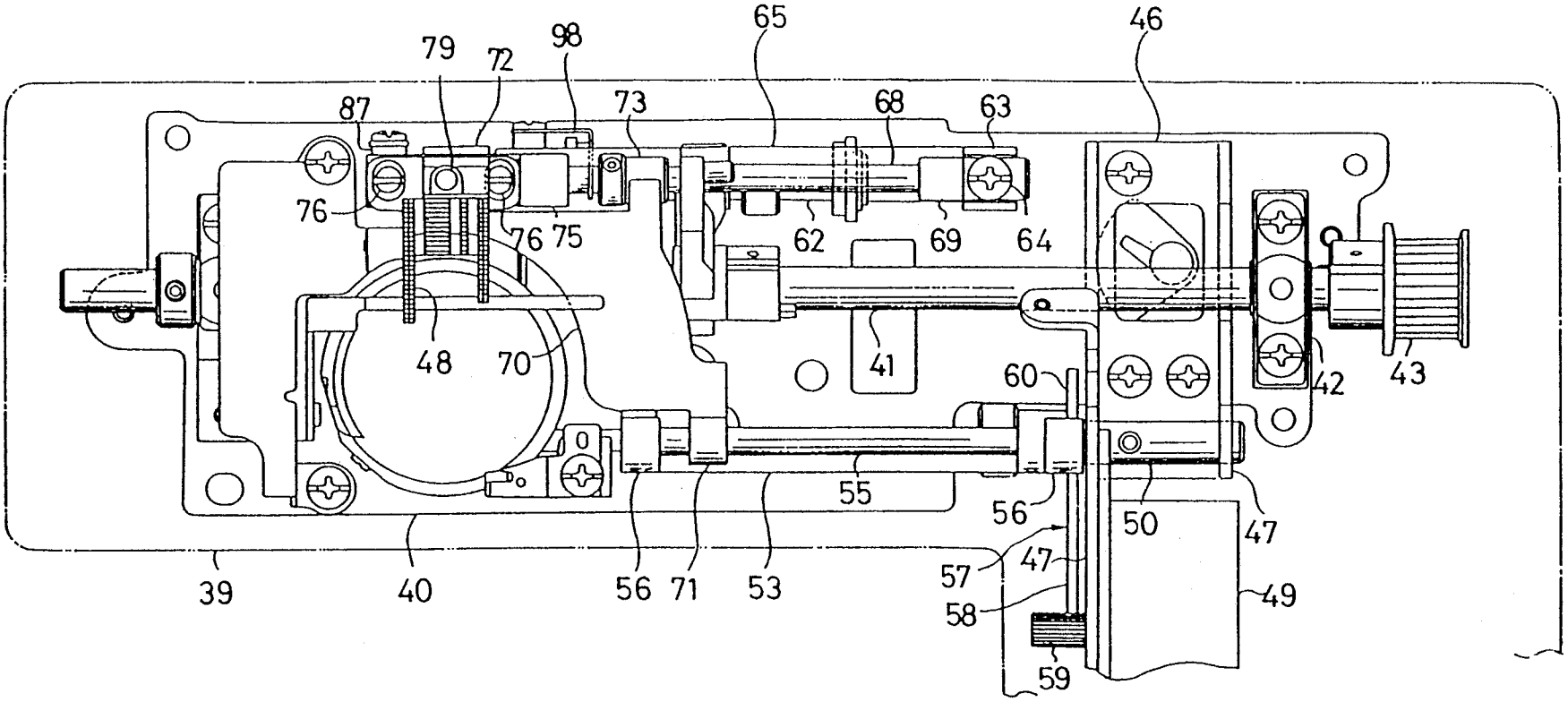
FIG. 3 is a plan view of equipment in a bed.
Figure 4:
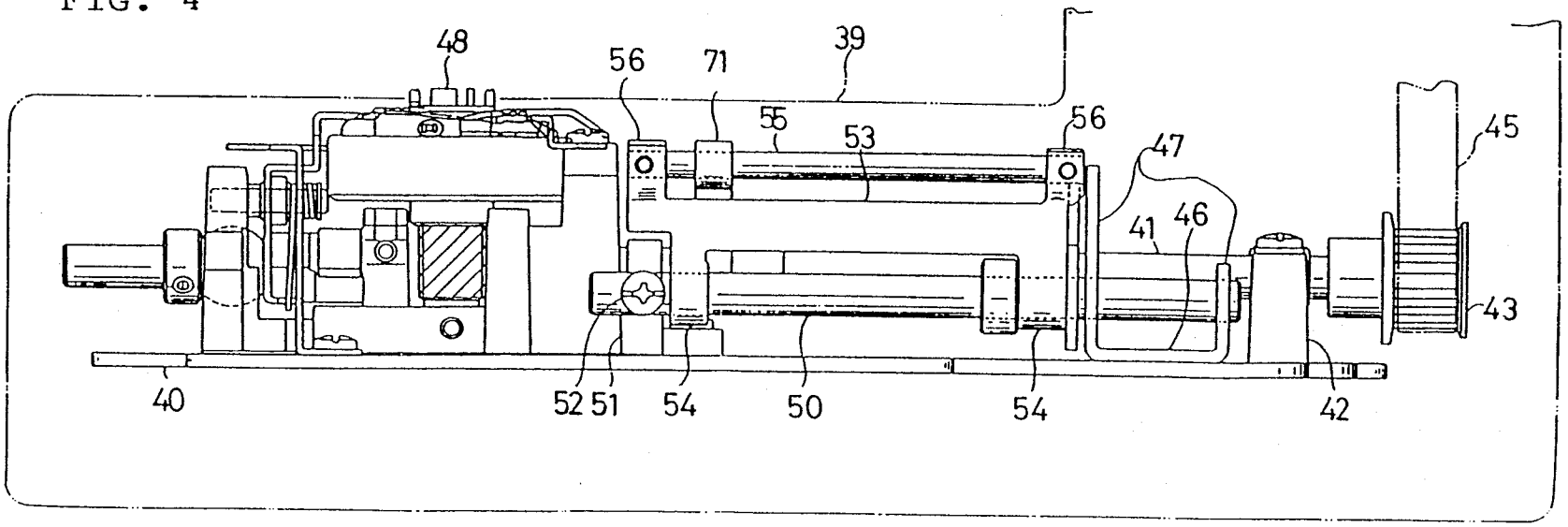
FIG. 4 is a front view of the equipment shown in FIG. 3.
Figure 5:
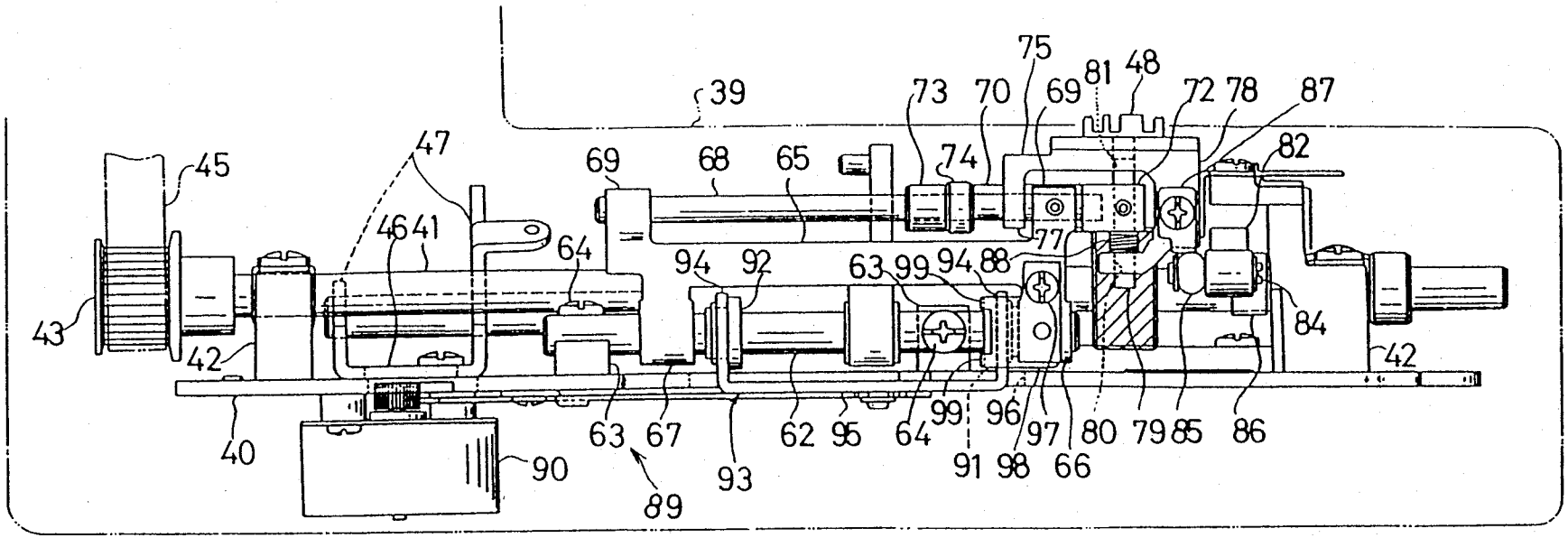
FIG. 5 is a rear view of the equipment shown in FIG. 3.

The needle bar lateral drive device 1 will be explained below with reference to FIGS. 1 and 2.

The needle bar lateral drive device 1 comprises a needle bar drive mechanism 2 with a needle bar lateral drive stepping motor 4, and a needle bar lateral drive mechanism 3 for moving the needle bar 5. Tee needle bar lateral drive mechanism 3 is controlled by the needle bar drive mechanism 2. The needle bar lateral drive stepping motor 4 is capable of rotating by discrete steps in either direction through a predetermined arc.

The needle bar drive mechanism 2 is controlled as described below. The needle bar lateral drive stepping motor 4 is attached to a fixing member 8 on its upper side. The fixing member 8 is fixed to a sewing machine frame via bolts 7. An output shaft 9 of the needle bar lateral drive stepping motor 4 extends upward through the fixing member 8 and a drive gear 10 is fixedly attached to the output shaft 9 to rotate therewith.

A sector gear 17, which engages with the drive gear 10 at its periphery, is rotatably supported at the front of the fixing member 8 via a pin 18. The pin 18 passes through a spacer 19. A connecting part 20 formed integrally with the sector gear 17 is connected with the right end of a connecting member 22. The connecting member 22 rotates around a pin 21 and is joined to a linkage 6 via a machine screw or the like.

Consequently, when the needle bar lateral drive stepping motor 4 works, it rotates the output shaft 9. Then the output shaft 9 rotates the drive gear 10. The sector gear 17 with the connecting part 20 rocks driving the linkage 6 from side to side via the connecting member 22.

The following is an explanation of an operation of the needle bar lateral drive mechanism 3. A needle bar lateral drive member 23 extending vertically comprises a pair of supporting parts 24 for supporting the needle bar 5, and a pair of supporting parts 26 supported rotatably on a rigid shaft 25. The rigid shaft 25 is fixed to fixing members 29 and 30 via machine screws or the like. The fixing members 29 and 30 are installed to the sewing machine frame via bolts or the like. A lateral drive part 31 is formed integrally with the lower one of the supporting parts 26 and is rotatably connected with the linkage 6 at is upper end via a pin 32.

When the linkage 6 is laterally moved by the needle bar lateral drive stepping motor 4, the needle bar lateral drive member 23 rocks around the rigid shaft 25 with the lateral drive part 31 Then the needle bar 5 with the needle 33 rocks within a preset angle.

The resolution of the needle bar lateral drive stepping motor 4 is 56 and the step angle is 6.429°. The minimum laterally moving pitch of the needle bar 5 is about 0.5 mm corresponding to one step of the needle bar lateral drive stepping motor 4.

Since the needle bar vertical drive device of the present zigzag sewing machine is a general one, its explanation is omitted.

A vertical feed device and a feed device in the bed 39 will be explained referring to FIGS. 3 through 7.

Near the bottom of the bed 39 a base plate 40 extends laterally and is fixed to the sewing machine frame. A lower shaft 41 rotatably supported by a plurality of bearings 42 on the base plate 40 extends longitudinally in the middle of the base plate 40. At the right end of the lower shaft 41 a pulley 43 is attached. Since a timing belt 45 is laid between the pulley 43 (FIGS. 4 and 5) and another pulley at the right end of an upper shaft 44 (FIG. 8), the lower shaft 41 rotates in exact timing with the upper shaft 44.

At the right end of the base plate 40 a channel member 46 is installed. The channel member 46 is almost U-shaped, as seen from the front. The left and taller one of side walls 47 of the channel member 46 extends forward and a feed stepping motor 49 is attached to the projecting part of the left one of the side walls 47 via a machine screw or the like. In the front of the base plate 40 a rigid shaft 50 longitudinally extends. The rigid shaft 50 passes through the right and left side walls 47 of the channel member 46 and is supported by a bearing 51 via a machine screw 52. The bearing 51 is located a little to the left of the middle of the base plate 40.

A first rocking member 53 has a pair of shaft supporting members 54, through which the rigid shaft 50 passes. Thus the first rocking member 53 rocks around the rigid shaft 50. A shaft 55 parallel to the rigid shaft 50 is supported by a pair of supporting parts 56 of the first rocking member 53.

Figure 7:
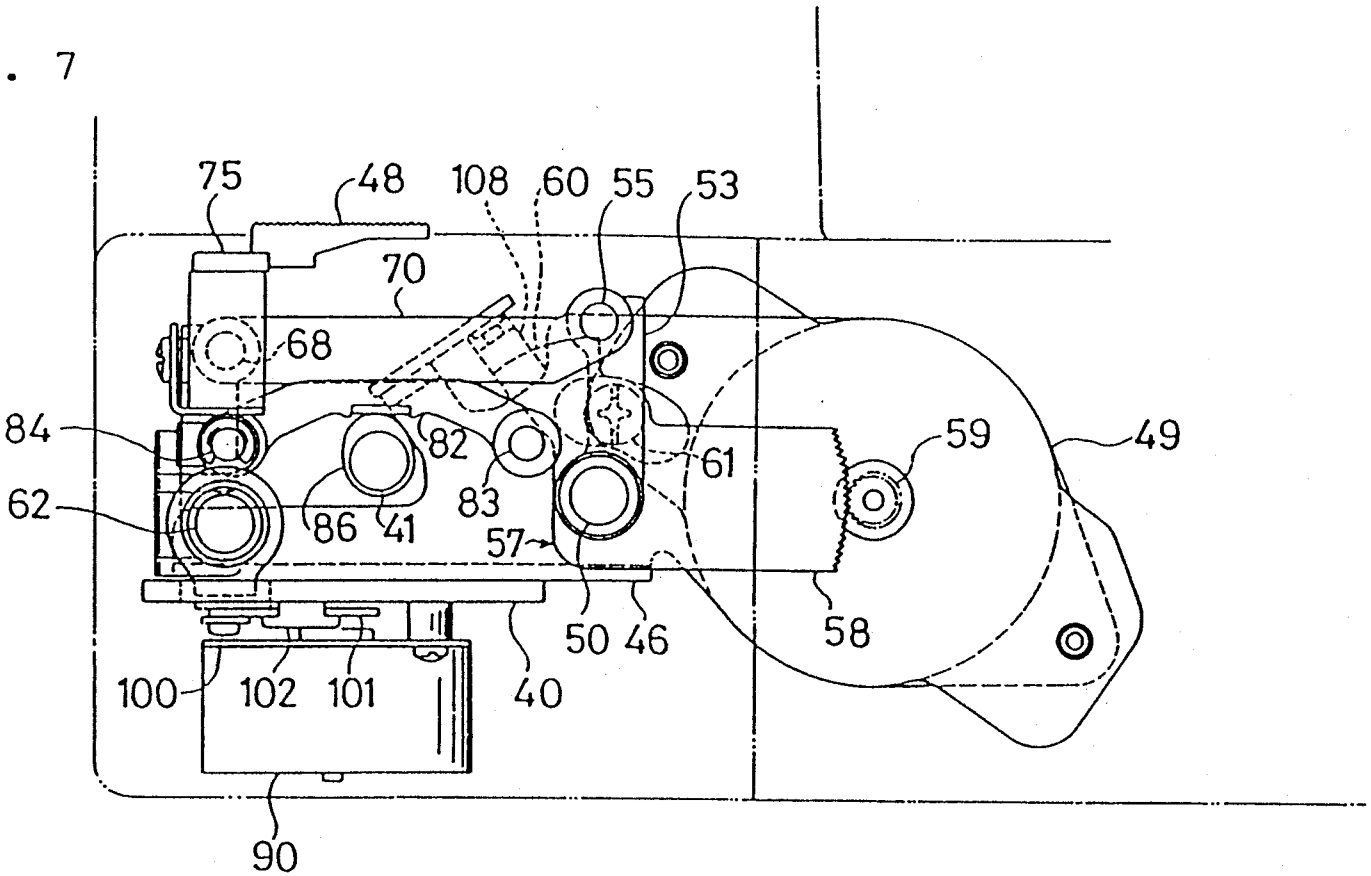
FIG. 7 is a left side view of the equipment shown in FIG. 3.

As seen in the FIG. 7, a lateral drive member 57 is installed between the first rocking member 53 and the channel member 46. The lateral drive member 57 is almost L-shaped as seen from the side and has a long arm 58 and a short arm 60. The lateral drive member 57 is rotatably supported on the rigid shaft 50. A curved sector agar is formed at the front end of the long arm 58 which is engaged with the drive gear 59 fixed on the output shaft of the feed stepping motor 49. A sensor 108 determines an original position of the lateral drive member 57. The short arm 60 is fastened to the first rocking member 53 via a machine screw 61. When the feed stepping motor 49 is driven in predetermined steps in either direction through a defined arc, the lateral drive member 57 and the first rocking member 53 rock together around the rigid shaft 50.

In the rear of the base plate 40 another rigid shaft 62 extends longitudinally almost in the middle of the base plate 40, and is fixed on a pair of pedestals 63 via machine screws 64. Since the rigid shaft 62 passes through shaft supporting members 66 and 67 of a second rocking member 65, the second rocking member 65 rocks around the rigid shaft 62. A shaft 68 parallel to the rigid shaft 62 is supported by a pair of supporting parts 69 of the second rocking member 65.

A connecting member 70 for transmitting the movement of the first rocking member 53 to the second rocking member 65 is provided with three shaft supporting members 71, 72, and 73. The shaft 55 passes through the shaft supporting member 71 and the shaft 68 through the shaft supporting member 73. The shaft supporting member 72 engages with the shaft 68 at a hole formed in its right side. Therefore, when the first rocking member 53 rocks, the connecting member 70 is driven back and forth and the second rocking member 65 rocks via the shaft 68. A rigid ring 74 is attached to the shaft 68 keeping in contact with the left side of the shaft supporting member 73 so as to prevent the connecting member 70 from moving laterally.

The feed dog 48 is fixed on a feed bar 75 via machine screws 76. The feed bar 75 has two projections 77 and 78. The first projection 77 extends downward from the right end of the feed bar 75 and has a U-shaped notch at its end. The notch engages with the shaft 68 and prevents the movement of the feed bar 75. The second projection 78 extends downward from the left end of the feed bar 75 and curves to the right. A drive pin 79 penetrates both a hole 80 at the end of the second projection 78 and a hole 81 in the feed bar 75 and the feed dog 48, and is fixed to the shaft supporting member 72 of the connecting member 70 via a machine screw. When the second rocking member 65 rocks, the feed dog 48 and the feed bar 75 are driven back and forth via the drive pin 79.

A lever 82 on the left of the feed bar 75 is fixed to the base plate 40 at its front end via a pin 83 and has a vertical drive member 85 at its rear end via a pin 84. Under the lever 82 an eccentric cam 86 is fixed on the lower shaft 41. The eccentric cam 86 rotating with the lower shaft 41 vertically moves the lever 82 around the pin 83. A plate 87 with L-shape seen from the side is attached to the second projection 78 at its vertically extending part via a machine screw. The laterally extending part of the plate 87 keeps in contact with the vertical drive member 85. A compression spring 88 around the drive pin 79 between the shaft supporting member 72 and the second projection 78 presses the plate 87 onto the vertical drive member 85. When the lower shaft 41 rotates with the eccentric cam 86, the lever 82 moves up and down. Then the vertical drive member 85 moves the plate 87, and the feed bar 75 and the feed dog 48 move up and down. In synchronization with the vertical movement, the feed dog 48 is driven back and forth by the feed stepping motor 49.

A crossfeed device 89 will be explained referring to FIGS. 3 through 7. A movable member 93 with laterally prolonged U-shape seen from the front comprises a pair of supporting parts 94 and a movable part 95. The supporting parts 94 are rotatably put on a pair of slidable rings 91 and 92 on the rigid shaft 62. The movable part 95 slightly projects downward from a rectangular cutout 96 in the base plate 40. The left end of the left one of the slidable rings 91 keeps in contact with the right side of a shaft supporting member 66. A plate 98 fixed to the shaft supporting member 66 via a machine screw 97 has a fork 99 which curves forward. Thus the shaft supporting member 66 and the slidable rings 91 and 92 move together. In other words, the second rocking member 65 and the movable member 93 slide along the rigid shaft 62 via the shaft supporting member 66.

Figure 6:
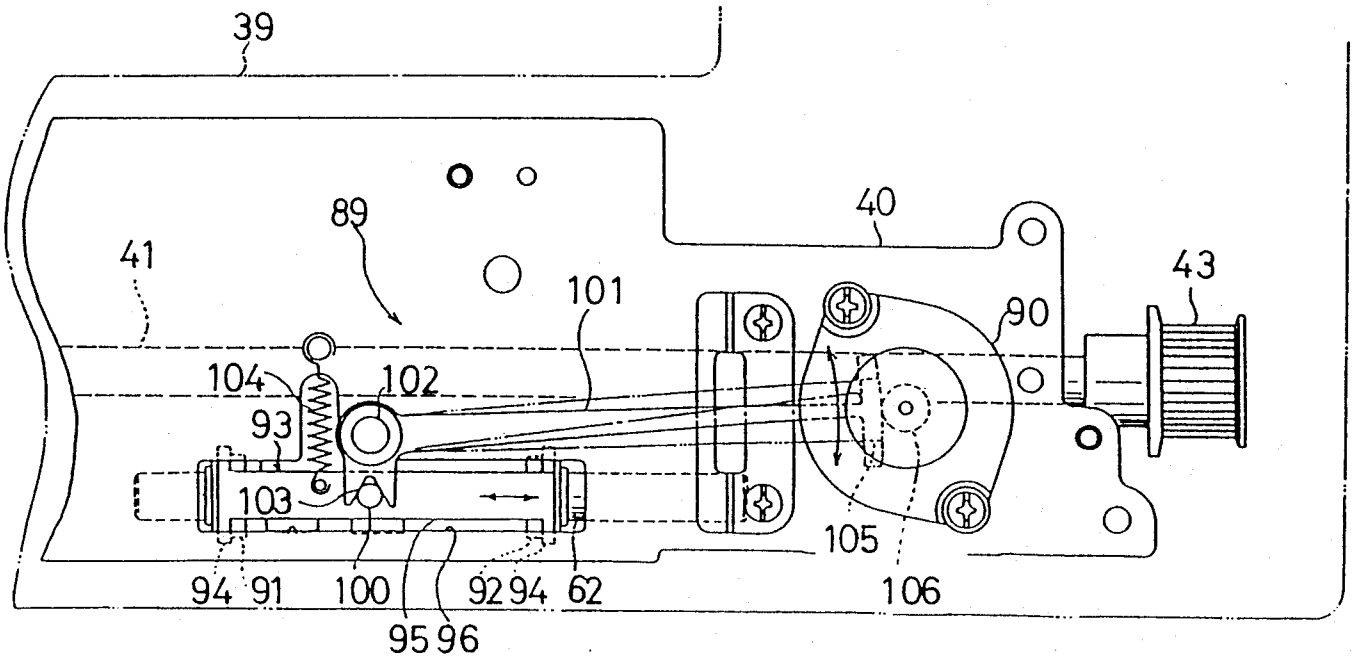
FIG. 6 is a brief bottom view of the equipment shown in FIG. 3.

As shown in FIG. 6, in the middle of the under side of the movable member 93 a pin 100 is attached. An arm 101 is rotatably fixed to the base plate 40 via a pin 102. The left end of the arm 101 is a fork-shaped output part 103 projecting backward. A tension spring 104 maintains the engagement of the pin 100 and the output part 103. The right end of the arm 101 is a curved magnifier 105 with a gear. The gear engages with the drive gear 106 of the crossfeed stepping motor 90, which rotates stepwise in either direction within a predetermined arc, mounted on the base plate 40. When the drive gear 106 moves the arm 101, the output part 103 moves the pin 100 and the movable member 93 from side to side. Then the second rocking member 65 and the connecting member 70 move the feed dog 48 from side to side via the drive pin 79. Thus a fabric 107 (see FIG. 10) is crossfed.

Resolution of the crossfeed stepping motor 90 is 30 and the step angle is 12.0°. Minimum crossfeeding pitch of the feed dog 48 is about 0.1 mm corresponding to one step of the crossfeed stepping motor 90. The minimum crossfeeding pitch is one-fifth of the minimum laterally moving pitch of the needle bar 5 which is controlled by the needle bar lateral drive device 1 driven by the needle bar lateral drive stepping motor 4.

Next, general organization of a control system of the present zigzag sewing machine.

Figure 8:
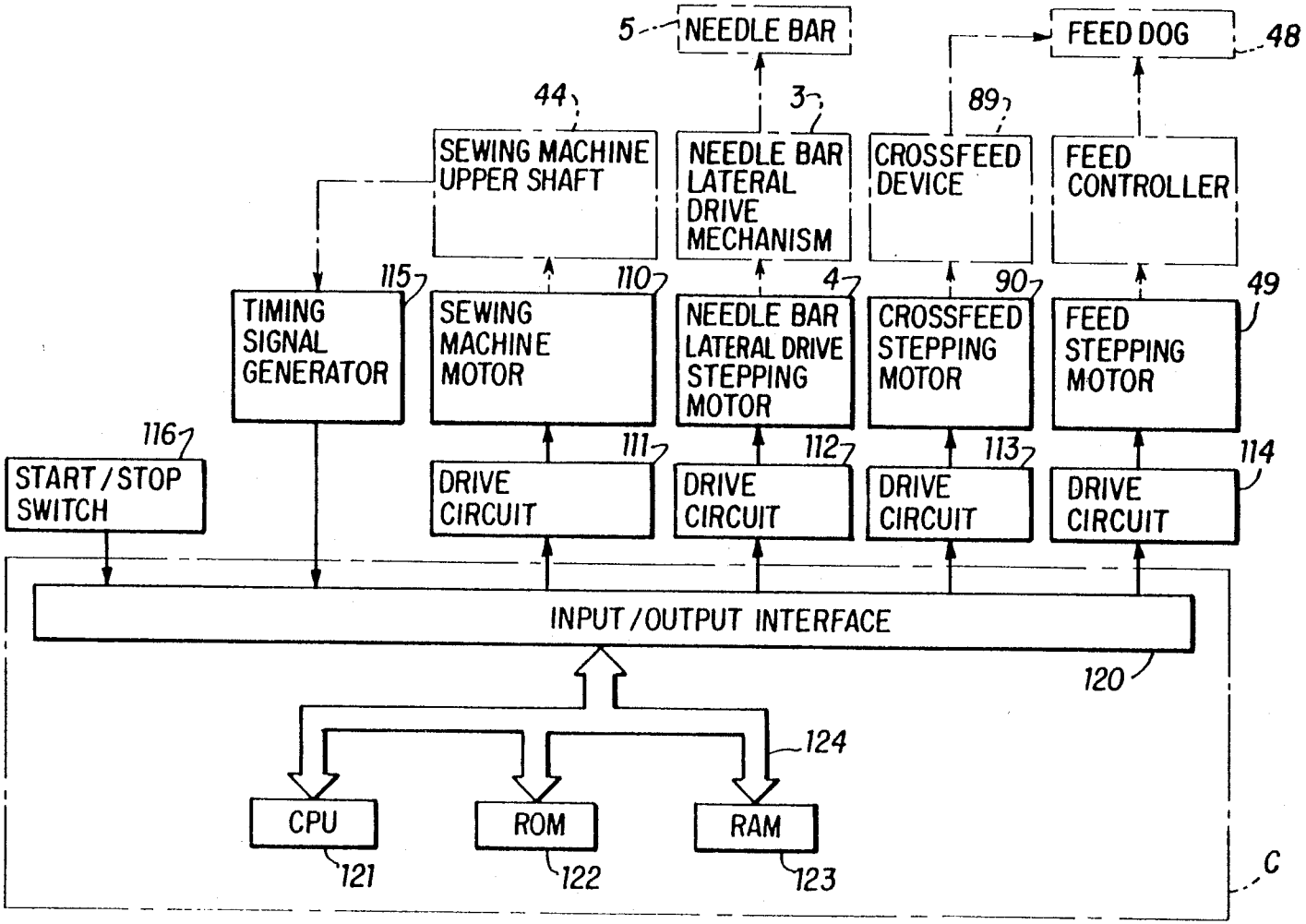
FIG. 8 is a block diagram of a control system of the sewing machine.

As shown in FIG. 8, a sewing machine motor 110, the needle bar lateral drive stepping motor 4, the crossfeed stepping motor 90, and the feed stepping motor 49 are controlled by drive circuits 111, 112, 113, and 114, respectively.

Figure 9:
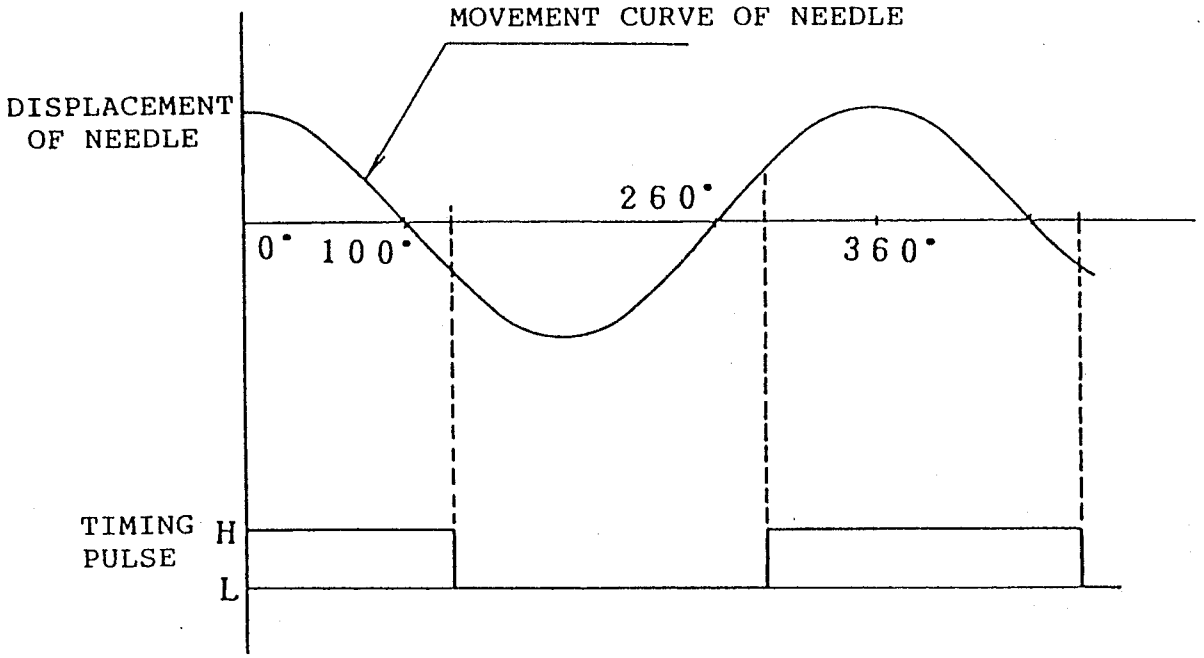
FIG. 9 is a time chart showing the operation of the sewing machine.

A timing signal generator 11 5 comprising a photointerrupter or the like outputs a timing pulse at a preset timing in synchronization with the rotation of the upper shaft 44 as shown in FIG. 9. When the needle 33 is at its top position, the phase of the upper shaft 44 is 0°. While the phase is between 0° and 120°, an "H" level signal is output from the timing signal generator 115, while the phase is between 120° and 280°, an "L" level signal is output, and while the phase is between 280° and 360°, an "H" level signal is output again.

A start/stop switch 11 6, the timing signal generator 115, and the drive circuits 111 through 114 are connected to an input/output interface 120 in a control device C.

In the control device C, ROM 122, RAM 123, and the input/output interface 120 are connected to CPU 121 by means of a bus 124 which includes a data bus.

The ROM 122 contains pattern data, a program, a control program, etc. In the pattern data, needle position data (amplitude data) for indicating a needle position and feeding amount data for indicating a feeding amount and direction of the feed stepping motor 49 are input with regard to a variety of patterns including a plurality of characters and ideograms. The program controls the needle bar lateral drive stepping motor 4, the crossfeed stepping motor 90, and the feed stepping motor 49 according to the selected pattern data and a timing pulse from the timing signal generator 115. The control program controls the sewing machine motor 110 in response to the start/stop switch 116.

The RAM 123 has a number of memory locations which temporarily contain calculations made by the CPU 121.

A needle location is determined to ensure cooperation between the needle 33 and the feed dog 44 as described below.

When the start/stop switch 116 is turned on, the sewing machine begins sewing. As shown in FIG. 9, when phase of the upper shaft 40 is about 120°, the timing pulse from the timing signal generator 115 changes from an "H" level to an "L" level and amplitude data regarding the next stitch is read from the ROM 122. When phase is about 280°, the timing pulse changes from an "L" level to an "H" level. At the same time a needle moving distance is calculated and then a feeding distance of the feed dog 48 is calculated. The needle moving distance equal an integer number times the minimum laterally moving pitch. The crossfeeding distance is shorter than the minimum laterally moving pitch of the needle 33. Subsequently, the needle 33 is moved by the needle bar lateral drive stepping motor 4, and the feed dog 48 is crossfed by the cross feed stepping motor 90.

Figure 10:
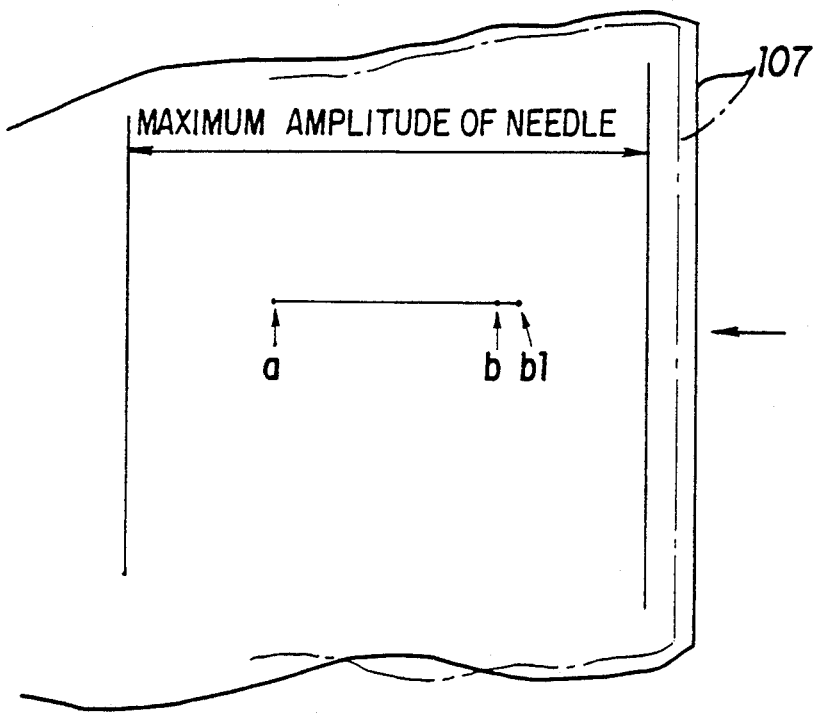
FIG. 10 is an illustration showing movement of a needle and a feed dog.

For example, in FIG. 10 the needle 33 is located at an a-position and amplitude data is 3.2 mm. When the needle bar lateral drive stepping motor 4 is driven 6 steps, the needle is moved 3.0 mm to a b-position. The needle moving distance is six times as long as the minimum laterally moving pitch (0.5 mm). On the other hand, when the crossfeed stepping motor 90 is driven 2 steps, the feed dog 48 is moved 0.2 mm in a direction opposite to that of the lateral moving direction of the needle 33. The fabric 107 is moved 0.2 mm leftward with the movement of the feed dog 48. Subsequently, the needle 33 is effectively displaced to the b,-position which is now 3.2 mm away from the a-position by the relative movement of the needle 33 and the fabric 107. Thus the needle location is decided in sequence. In another case where amplitude data is 3.8 mm, the needle 33 is moved 8 times longer than the minimum laterally moving pitch (0.5 mm) and the feed dog 48 is moved 0.2 mm in the lateral moving direction of the needle 33 by 2 steps driving of the crossfeed stepping motor 90.

As explained above, the present zigzag sewing machine can set up a minute amplitude data in 0.1 mm units and sew beautiful pattern stitches and neat stitches by means of the crossfeed device 89 controlled by the crossfeed stepping motor 90, because the minimum feeding pitch of the feed dog 48 (0.1 mm) is smaller than the minimum laterally moving pitch of the needle 33 (0.5 mm).

Furthermore, the fabric 107 is moved by the relative movement of the needle 33 and feed dog 48, and the minimum relative moving pitch is equal to the minimum feed pitch of the feed dog 48. Since the minimum laterally moving pitch of the needle 33 is longer than the minimum feeding pitch of the feed dog 48, the needle 33 is driven by an inexpensive needle lateral drive stepping motor 4 with neither high resolution nor high speed responsiveness. In addition, an inexpensive crossfeed stepping motor 90 without high resolution can drive the feed dog 48 in 0.1 mm units by making the drive transmission ratio smaller.

It should be understood that the minimum lateral moving pitch (0.5 mm) and the minimum feeding pitch (0.1 mm) are supposed as examples and that the present invention can be applied to a variety of crossfeed devices.

What is claimed is:

1. A zigzag sewing machine comprising:

a needle bar;

a needle attached to the needle bar for sewing a fabric;

needle bar vertical drive means for moving the needle and needle bar up and down;

feeding means for feeding the fabric in a forward and back feed direction;

crossfeeding means for moving the fabric in increments of a minimum crossfeeding pitch in a first direction and a second direction, the first and second directions being orthogonal to the forward and back feed direction, while the needle is moved above the fabric by the needle bar vertical drive means; and needle bar lateral drive means for moving the needle and needle bar in increments of a minimum laterally moving pitch in the first direction and the second direction while the needle is moved above the fabric by the needle bar vertical drive means, wherein the minimum laterally moving pitch is greater than the minimum crossfeeding pitch, the crossfeeding means comprises a feed dog, a crossfeed step motor and a crossfeed transmission, the crossfeed transmission connects the crossfeed step motor with the feed dog such that the crossfeed transmission transmits motion of the crossfeed step motor to the feed dog in a first transmission ratio; and the needle bar lateral drive means comprises a lateral step motor and a lateral drive transmission where the lateral drive transmission connects the lateral step motor with the needle bar such that the lateral drive transmission transmits motion of the lateral step motor to the needle bar in a second transmission ratio, and wherein the first transmission ratio is smaller than the second transmission ratio.

2. The zigzag sewing machine of claim 2, wherein the needle is moved a desired distance relative to the fabric in the first direction and the second direction by moving the fabric with the crossfeeding means and moving the needle and needle bar with the needle bar lateral drive means.

3. The zigzag sewing machine of claim 2, wherein the desired distance obtained can have a resolution corresponding to that of the minimum cross-feeding pitch by moving the needle bar a first number of minimum laterally moving pitches and then moving the feed dog a second number of minimum crossfeeding pitches.

4. The zigzag sewing machine of claim 3, wherein the feeding means comprises a feed step motor and a feed transmission for connecting the feed step motor with the feed dog, whereby the feed dog moves the fabric in the forward and back feed direction.

5. The zigzag sewing machine of claim 1 further comprising:

memory means for storing a plurality of pattern data corresponding to a plurality of patterns to be sewn on the fabric; and control means for controlling the feeding means, crossfeeding means, and needle bar lateral drive means according to a pattern data corresponding to a desired pattern chosen from the plurality of patterns such that the needle sews the desired pattern on the fabric.

6. The zigzag sewing machine of claim 5, wherein the pattern data for each of the plurality of patterns comprises feed amount data and feed direction data for controlling the feeding means, crossfeed amount data and crossfeed direction data for controlling the crossfeeding means, and needle bar movement amount data and needle bar direction data for controlling the needle bar lateral drive means.

7. The zigzag sewing machine of claim 6, wherein the feed amount data corresponds to a third number of minimum feeding pitches, the crossfeed amount data corresponds to a second number of minimum crossfeeding pitches, and the needle bar movement amount data corresponds to a first number of minimum laterally moving pitches.

8. The zigzag sewing machine of claim 1 further comprising needle position determining means for determining whether the needle is up or down, wherein the feeding means feeds the fabric, the crossfeeding means moves the fabric, and the needle bar lateral drive means moves the needle and needle bar when the needle position determining means determines that the needle is up.

9. A zigzag sewing machine comprising:

a needle bar;

a needle attached to the needle bar for sewing a fabric;

needle bar vertical drive means for moving the needle and needle bar up and down;

a feed dog;

feeding means connected to the feed dog for feeding the fabric in a forward and back feed direction;

crossfeeding means comprising a crossfeed actuator and a crossfeed transmission for moving the fabric in increments of a minimum crossfeeding pitch in a first direction and a second direction, the first and second direction being orthogonal to the forward and back feed direction wherein the crossfeed actuator is connected with the feed dog through the crossfeed transmission such that the crossfeeding means moves the fabric in increments of the minimum crossfeeding pitch by moving the feed dog, while the needle is moved above the fabric by the needle bar vertical drive means; and needle bar lateral drive means comprising a lateral actuator and a lateral drive transmission, wherein the lateral actuator is connected with the needle bar through the lateral drive transmission such that the needle bar lateral drive means moves the needle and needle bar in increments of a minimum laterally moving pitch in the first direction and the second direction, wherein the minimum laterally moving pitch is greater than the minimum crossfeeding pitch, the crossfeed transmission connects the crossfeed actuator with the feed dog such that the crossfeed transmission transmits motion of the crossfeed actuator to the feed dog in a first transmission ratio; and the lateral drive transmission connects the lateral actuator with the needle bar such that the lateral drive transmission transmits motion of the lateral actuator to the needle bar in a second transmission ratio, wherein the first transmission ratio is smaller than the second transmission ratio.

10. The zigzag sewing machine of claim 9, wherein the crossfeed actuator is crossfeed step motor and the lateral actuator is a lateral step motor, wherein a resolution of the lateral step motor is greater than a resolution of the crossfeed step motor.

11. The zigzag sewing machine of claim 9, wherein the minimum laterally moving pitch is 0.5 mm.

12. The zigzag sewing machine of claim 9, wherein the minimum crossfeeding pitch is 0.1 mm.

* * * * *